US006080002A

United States Patent [19]

Macleod et al.

[11] Patent Number: 6,080,002

[45] Date of Patent: Jun. 27, 2000

[54] METHOD AND APPARATUS FOR SECURING THE CONTINUITY OF A POWER SUPPLY TO AN ELECTRICAL APPLIANCE

[75] Inventors: Stuart Bruce Macleod, Sandton; Gregory Jay Whatmore, 25 Shelton Avenue, Harmelia, Edenvale, both of South Africa

[73] Assignee: Gregory Jay Whatmore, Edenvale, South Africa

[21] Appl. No.: 09/181,828

[22] Filed: Oct. 28, 1998

Related U.S. Application Data

[63] Continuation-in-part of application No. 08/721,142, Sep. 26, 1996, Pat. No. 5,829,999.

[30] Foreign Application Priority Data

Sep. 27, 1995 [ZA] South Africa ..... 95/8107

[51] Int. Cl.[7] ..... H01R 4/50

[52] U.S. Cl. ..... 439/346; 439/102

[58] Field of Search ..... 439/346, 102, 439/265, 270, 359, 135, 299; 200/43.01, 50.28, 50.31, 333

[56] References Cited

U.S. PATENT DOCUMENTS

| | | | |
|---|---|---|---|
| 2,674,722 | 4/1954 | Hubbell et al. | 339/14 |
| 2,683,864 | 7/1954 | Hubbell et al. | 339/14 |
| 2,872,654 | 2/1959 | Smith | 339/14 |
| 3,890,025 | 6/1975 | Gray | 339/14 |
| 4,111,509 | 9/1978 | Novak | 439/102 |
| 4,199,207 | 4/1980 | Lee | 339/14 |
| 5,480,318 | 1/1996 | Garrison | 439/346 |
| 5,582,180 | 12/1996 | Manset et al. | 439/135 |

FOREIGN PATENT DOCUMENTS

| | | |
|---|---|---|
| 1142020 | 6/1959 | Germany . |
| 812399 | 7/1957 | United Kingdom . |
| 2 193 047 | 1/1988 | United Kingdom . |

*Primary Examiner*—Paula Bradley
*Assistant Examiner*—Tho D. Ta
*Attorney, Agent, or Firm*—Woodcock Washburn Kurtz Mackiewcz & Norris LLP

[57] ABSTRACT

An electrical plug is equipped with an earthing pin 180 comprises an elongate metal body 260 defining a groove for holding captive a split band 460 of a moulded plastic material, which has inwardly facing nodes 480 which are receivable in a transverse passage through the body. The body 260 further defines a longitudinal threaded bore for receiving a threaded shank 380 having a tapered tip which, in use, is seated between the inner nodes on the band 460. When the pin 180 is inserted into a corresponding socket of an existing electrical outlet (not shown) and a circular cap 420 on the exposed end of the threaded shank 380 is rotated, the tip of the shank 400 bears against the nodes 480 on the band 460, thereby expanding the band radially outwardly until it frictionally engages an adjacent portion of the socket in which the pin 180 is located. The pin 180 together with any electrically conducting pins associated with the same plug are hence secured against inadvertent extraction from their respective sockets.

11 Claims, 5 Drawing Sheets

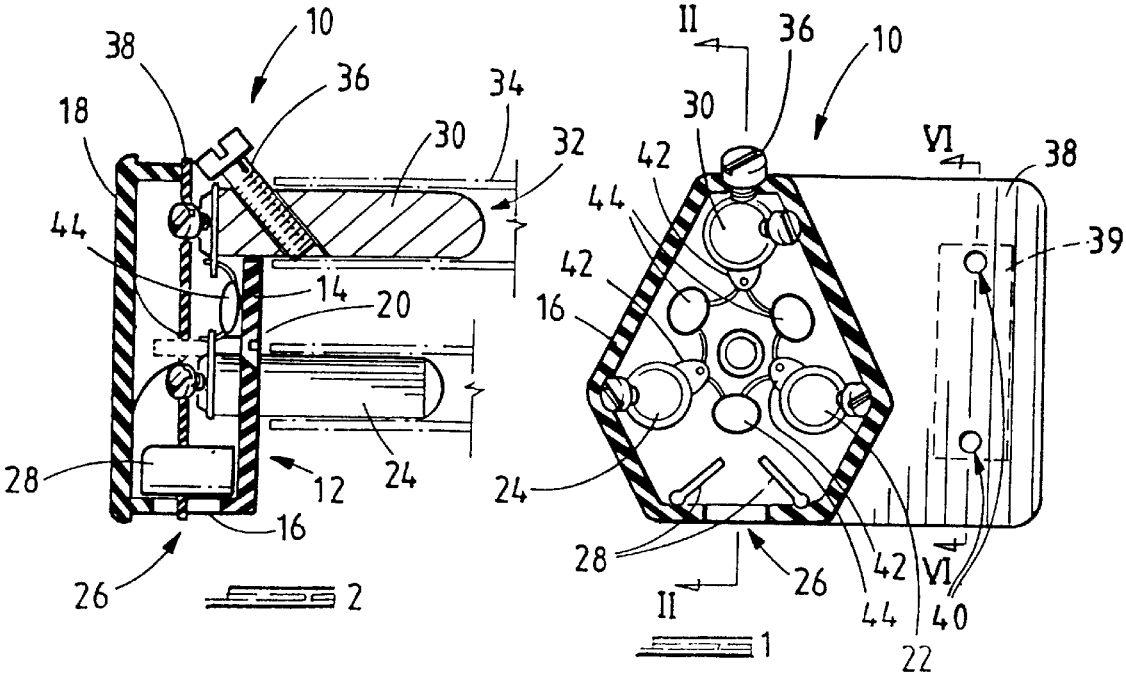
10
38
36
18
34
30
32
44
14
20
28
12
24
16
26
2
II
36
10
30
42
44
42
16
VI
38
39
24
28
26
42
VI
II
44
40
22
1
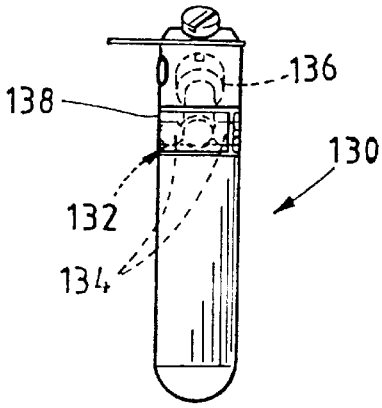
136
138
130
132
134
3

METHOD AND APPARATUS FOR SECURING THE CONTINUITY OF A POWER SUPPLY TO AN ELECTRICAL APPLIANCE

CROSS-REFERENCE TO RELATED APPLICATION

This application is a continuation-in-part of application Ser. No. 08/721,142, filed Sep. 26, 1996 now U.S. Pat. No. 5,829,999 , entitled "Method and Apparatus for Securing the Continuity of a Power Supply to an Electrical Appliance."

FIELD OF THE INVENTION

This invention relates to a method of securing A continuous power supply to an electrical appliance. The invention extends to an electrical plug and, specifically, to any non-conducting locating formation on the plug, which is receivable in a complementary socket of a chosen electrical outlet.

BACKGROUND TO THE INVENTION

Most commercially available electrical appliances are equipped with flexible electrical cords and plugs for drawing power from an electrical mains supply through complementary outlets. These outlets are usually equipped with switches for optionally interrupting the supply of electricity to the respective appliances.

Certain electrical appliances such as video cassette recorders rely on built-in, electrically driven clocks to operate according to a predetermined schedule. Any power interruption will accordingly disrupt the desired operation of the appliance, particularly when it does not have an electrical backup system of its own.

Other appliances such as burglary protection systems or personal computers require a continuous supply of electricity for operating in a standby mode. Any uncontrolled power interruptions will obviously defeat the normal operation of these appliances.

These interruptions may be attributable to inadvertent switching off of the power supply at a given socket. In other instances the plug of the affected appliance may be withdrawn either deliberately or unintentionally from its socket.

The present invention is directed at counteracting power interruptions of this nature.

SUMMARY OF THE INVENTION

The present invention provides method of securing the continuity of a power supply to an appliance having an electrical cord connected to a plug having at least a pair of electrically conductive pins and a passive pin which are simultaneously receivable in respective sockets of an existing electrical outlet, comprising the steps of inserting the conducting pins and the passive pin into their respective sockets of an existing electrical outlet to establish a power supply path along the cord to the appliance; and locking the passive pin in its associated socket in order to counteract extraction of the conducting pins from their respective sockets by displacing a threaded screw lying in a threaded passage through the passive pin towards a transverse passage through the passive pin such that the threaded screw is interposed between a pair of displaceable elements located in a transverse passage through the passive pin and connected to a resilient frictional element that is circumferentially held captive on the passive pin by a corresponding groove in the passive pin, such that the displaceable elements radially expand the frictional element beyond an outer peripheral region of the passive pin and towards an adjacent portion of its associated socket in order to counteract extraction of the pins from their respective sockets.

The method provided by the present invention may include a further step of restricting access to a switch for interrupting the power supply to an outlet in which the plug is located. This may be done by providing shielding means on the plug which shields the switch from uncontrolled access.

The present invention also extends to a plug for securing the continuity of a power supply through an electrical cord to an electrical appliance, comprising an insulating body supporting at least a pair of electrically conducting pins for establishing an electrical power supply path along the cord, and a passive pin spaced from the conductive pins, all pins being simultaneously receivable in respective sockets of an existing electrical outlet; a passage extending transversely through the passive pin such that two extremities at an outermost peripheral region of the passive pin are respectively defined; a resilient frictional element held captive on the passive pin by a corresponding groove and overlying the extremities of the transverse passage through the passive pin, the frictional element further having a pair of formations respectively locatable in each of the extremities of the transverse passage; and a locking means on the passive pin, for laterally displacing the formations on the frictional element in use, operating to urge the frictional element toward an adjacent portion of its associated socket, thereby counteracting extraction of the conducting pins and the passive pin from their respective sockets.

The body of the plug may comprise a shielding formation for shielding at least partially an electrical switch located adjacent to an electrical outlet for use in conjunction with the plug.

The resilient frictional element may be in the form of a split band fitting into a corresponding circumferential groove in an outer peripheral region of the passive pin.

The formations on the frictional element may comprise a pair of opposing nodes, integrally connected to the band, and converging radially towards each other.

The locking means may comprise a threaded shank having a tip which is locatable between the formations of the frictional element in order to laterally displace the formations during use and thereby urge the frictional element radially outwardly.

The present invention further provides a pin for use on a plug for securing a continuous power supply path through an electrical cord to an appliance, comprising an elongate body which is receivable in a complementary socket of an electrical outlet; a passage extending transversely through the elongate body such that two extremities at an outermost peripheral region of said body are respectively defined; a resilient frictional element held captive on said body by a corresponding groove and overlying the extremities of the transverse passage through the passive pin, the frictional element further having a pair of formations respectively locatable in each of the extremities of said transverse passage; and locking means for laterally displacing the formations on the frictional element in use, operating to urge the frictional element radially outwardly in relation to the body.

The meaning of the term "passive pin" in the context of the present description includes any pin in the plug which does not form part of the normal power supply path to the appliance. This may conveniently be an earthing pin for directing stray electrical currents from the appliance to earth. The meaning of this term extends, however, to and non-conducting locating formation on the plug, which is receivable in a complementary socket of a chosen electrical outlet.

BRIEF DESCRIPTION OF THE DRAWINGS

The invention is described below way of example in which

FIG. 1 shows an upper plan view of an electrical plug according to the present invention, without a cover, for ease of illustration;

FIG. 2 shows a sectional side elevational view taken along II—II on the plug of FIG. 1;

FIG. 3 shows a side elevational view of a preferred earthing pin, on an enlarged scale, for use in conjunction with a plug, similar to that of FIG. 1;

DESCRIPTION OF PREFERRED EMBODIMENTS

Figure 4:
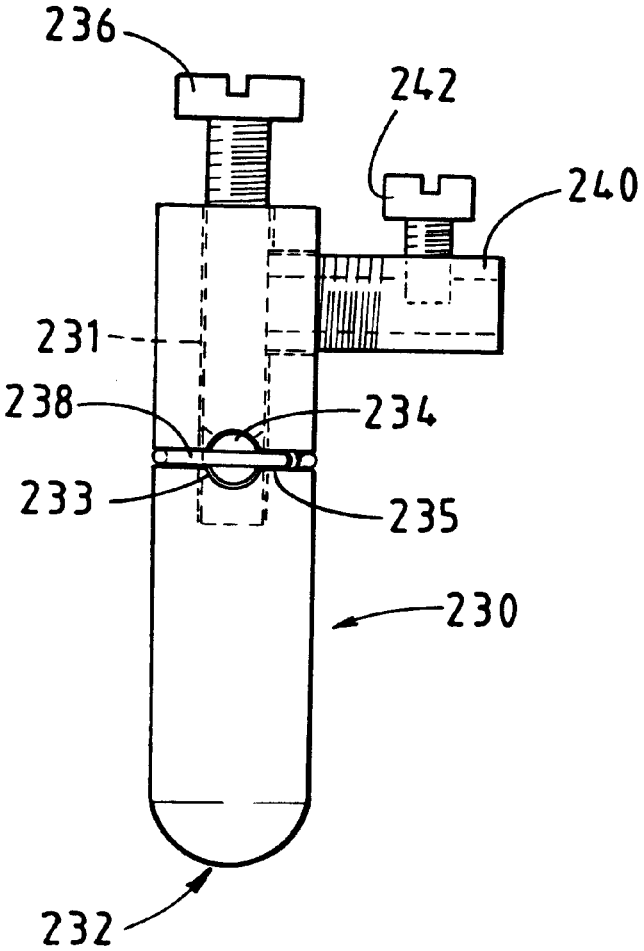
FIG. 4 shows a side elevational view of a particulary preferred earthing pin, on an enlarged scale, for use in conjunction with a plug similar to that of FIG. 1.

In FIGS. 1 and 2 reference numeral 10 generally denotes an electrical plug according to the present invention. The plug 10 has a moulded plastic body 12 comprising a base plate 14 and upstanding edges 16. The plug 10 is generally symmetrical about the sectional reference line II—II shown in FIG. 1.

A complementary moulded plastic cover 18 fits on the upstanding edges 16, and is held in position by a locking screw 20, which passes through the base plate 14. The cover 18 is omitted from FIG. 1 to reveal the internal components of the plug 10.

Two brass pins 22 and 24 of substantially, similar dimensions pass through the base plate 14. The pins 22 and 24 lie in perpendicular relationship to the base plate 14, and are arranged in symmetrical relationship to the reference line II—II. The pins 22 and 24 are respectively connectable in known fashion to a live and a neutral conductor of an electrical cord (not shown).

In use the cord passes through an aperture 26 between a pair of resilient, opposing locking plates 28 which are held captive by the body 12. The plates 28 are biased towards each other to grip the cord between them, thereby providing strain relief on the conductor connections within the body 12 whenever the cord is subjected to any external tension. The features described thus far are generally found with relatively minor adaptations in numerous commercially available electrical plugs.

The plug 10 further includes an elongate, metal earthing pin 30 spaced from the pins 22 and 24. A portion of the pin 30 lies within the body 12, and is connectible to the earth conductor of a commercially available electrical cord of the kind mentioned above.

The unconnected end 32 of the pin 30 projects from the body 12, and is slidingly receivable in a closely, fitting metal sleeve 34 of an existing domestic electrical outlet (not further illustrated).

A threaded passage extends through the pin 30 in oblique relationship to its longitudinal axis. The openings to this passage lie on either side of the base plate 14. A locking screw 36 fitting into the oblique passage through the pin 30 is optionally rotatable by means of a screwdriver (not shown). The head of the screw 36 may be adapted to fit a customized tool to limit any unauthorized access.

In use the plug 10 is inserted into a selected electrical outlet for receiving the pins 22, 24 and 30 in known fashion. The screw 36 is then rotated until its tip bears against an adjacent portion of the sleeve 34. The frictional contact between the screw 36 and the sleeve 34 safeguards the plug 10 against inadvertent removal, and against unauthorized removal by persons not having the appropriate tool.

The plug is made even more effective against undesired power interruptions on an associated appliance by providing a switch cover 38 which is sandwiched between the body 12 and the cover 18 of the plug, as shown in FIG. 2. A portion of the cover 38 projects laterally from the body 12, extending across the usual location of an electrical switch 39.

When the plug 10 is locked in position in the manner described above, the cover 38 simultaneously denies other users normal access to the switch 39 for interrupting the power supply to the plug 10. A pair of apertures 40 is conveniently provided for inserting a rod or similar tool for optionally activating or deactivating the switch 39 by depressing the appropriate switch portion.

The plug 10 is conveniently provided with 3 soldering terminals 42 which are respectively crimped on to each of the pins 22, 24 and 30. Three commercially available metal oxide varistors 44 are connected between each pair of terminals 42, and lie within the body 12, adjacent to the base plate 14.

The varistors 44 are designed to protect appliances connected to the plug 10 against spurious over voltage conditions. The varistors 44 are conveniently arranged. to minimize any interfere with the normal connection of electrical conductors to their respective pins 22, 24 and 30.

FIG. 3 shows an earthing pin 130 which is usable in similar fashion as the pin 30. The pin 130 has the same general external dimensions as the pin 30. The pin 130 has a corresponding oblique, threaded passage which in use commences above the base plate 14, and terminates in a transverse passage 132 extending across the diameter of the pin 130.

A pair of metal spheres 134, only one of which is visible in FIG. 3, is located in the passage 132. A locking screw 136 lying in the oblique passage is arranged between the spheres 134. In use the screw 136 urges the spheres. away from each other, and against a split ring 138, which is; held captive on the cylindrical portion of the pin 130 in a corresponding groove.

The ring 138 is manufactured of a resilient metal, and is dimensioned so that in its relaxed state it does not protrude beyond the general outer surface of the cylindrical portion of the pin 130. This permits a plug equipped with the pin 130 to be inserted in an available electrical socket in known fashion.

When the plug is in place, the locking screw 136 is operated in the manner described above to expand the ring 138 until it bears frictionally against an adjacent portion of its associated socket. The plug is hence similarly safeguarded against undesired removal.

Figure 5:
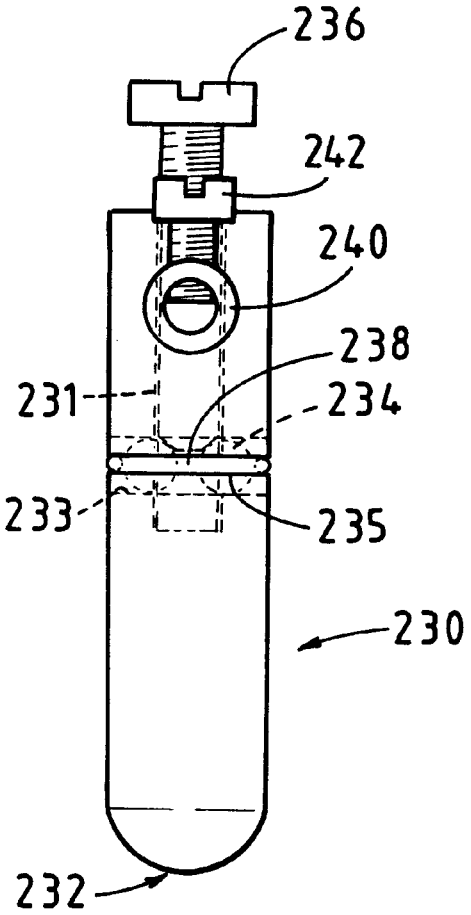
FIG. 5 shows a front elevational view of the pin of FIG. 4.
Figure 6:
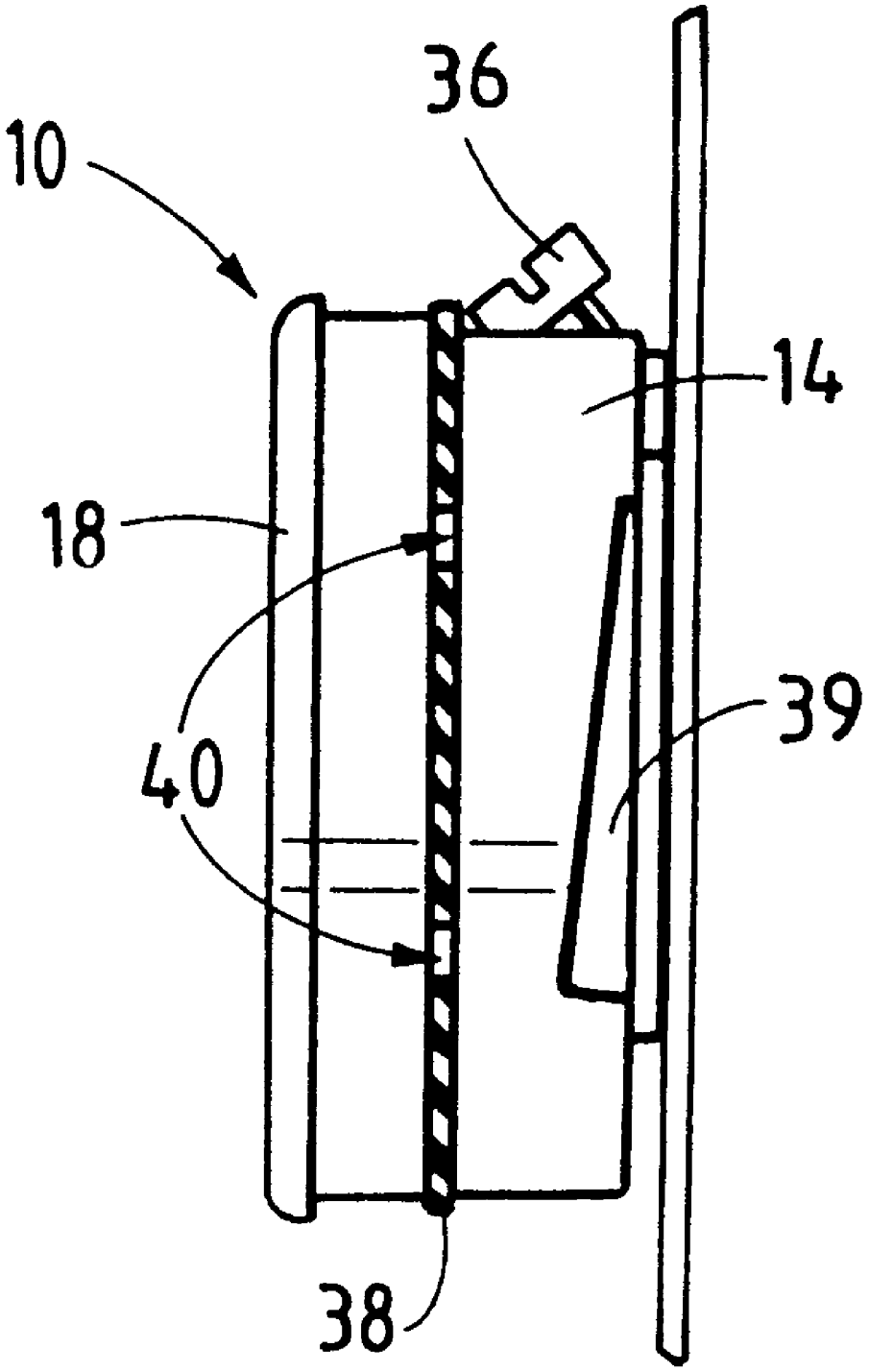
FIG. 6 shows a sectional view in side elevation taken along VI—VI on the plug in FIG. 1, in use.

FIGS. 4 and 5 depict a particularly preferred earthing pin 230 having a longitudinal metal body of circular cross section, terminating in a rounded tip 232. In use the pin 230 conveniently forms part of a plug of the kind illustrated in FIGS. 1 and 2. The pin 230 is accordingly so dimensioned as to fit slidingly into a metal sleeve 34 forming part of an existing electrical mains outlet (FIG. 2).

The pin 230 has an axial, threaded passage 231 extending from the end of the pin furthest from the rounded tip 232 towards an intermediate, transverse passage 233 pas sing through the body of the pin. The passage 233 intersects a peripheral, radial groove 235 ill the outer periphery of the body of the pin 230, roughly mid-way between its ends.

A resilient deformable metal ring 238 nesting in the groove 235 is held captive by the body of the pin 230, thereby confining a pair of metal spheres 234 to the passage 235. The ring 238 in its relaxed state generally lies within the outer peripheral area of the body of the pin 230 to permit insertion of the pin into a corresponding socket of an electrical mains outlet.

The spheres 234 correspond generally to the spheres 134 of the pin 130 shown in FIG. 3, and fit with minimal lateral clearance into the passage 233. A locking screw 236 which co-operates with the thread of the axial passage 231 has a leading tip abutting against each of the spheres 234.

The spheres 234 simultaneously bear against the inner peripheral region of the ring 238. In use the advancing locking screw 236 accordingly urges the spheres 234 in opposing directions, thereby causing the ring 238 to expand radially until it bears frictionally against an adjacent metal sleeve of an existing electrical mains outlet (not shown).

The pin 230 is conveniently fitted to an electrical plug, such as the plug 10 shown in FIGS. 1 and 2. The head of the locking screw 236 is preferably housed within the plug cover 18, and is accessible through a corresponding aperture (not shown) in the cover. The plunge is hence secured against inadvertent or deliberate extraction from its associated electrical mains for as long as the screw 236 is maintained in its locking position.

The pin 230 is equipped with a partially threaded metal bush 240 which enters the body of the pin by way of a complementary threaded passage extending radially from the axial passage 231. The bush 240 defines a bore 242 for receiving the termination of an existing earth wire (not shown) forming part of an electrical cord connected to an electrical appliance.

A fastening screw 242 fitting into a complementary threaded passage intersecting the bore of the bush 240 provides a convenient means for securing the termination of the earth wire mentioned above in known fashion.

Figure 7:
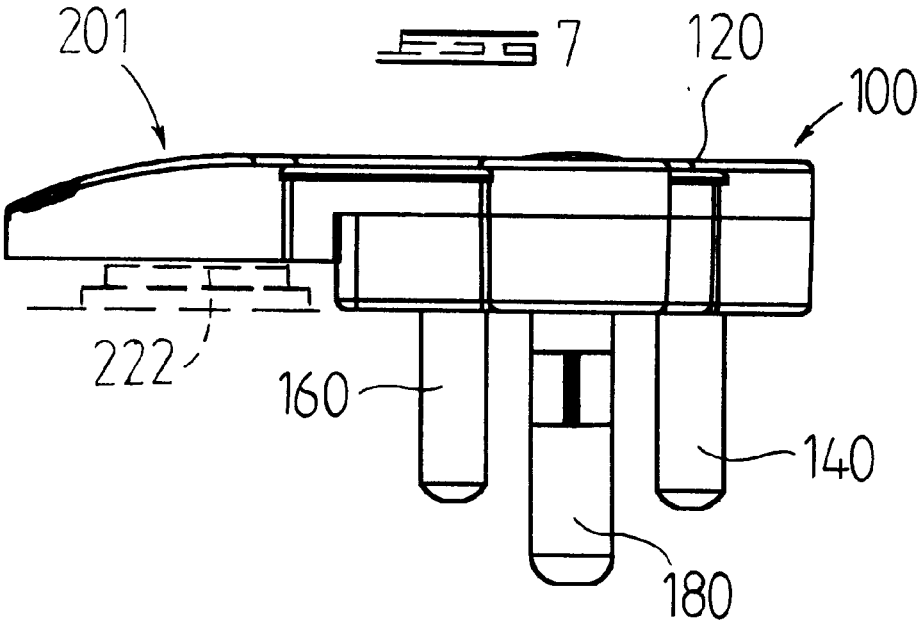
FIG. 7 shows an electrical plug according to the present invention, viewed in side elevation.
Figure 8:
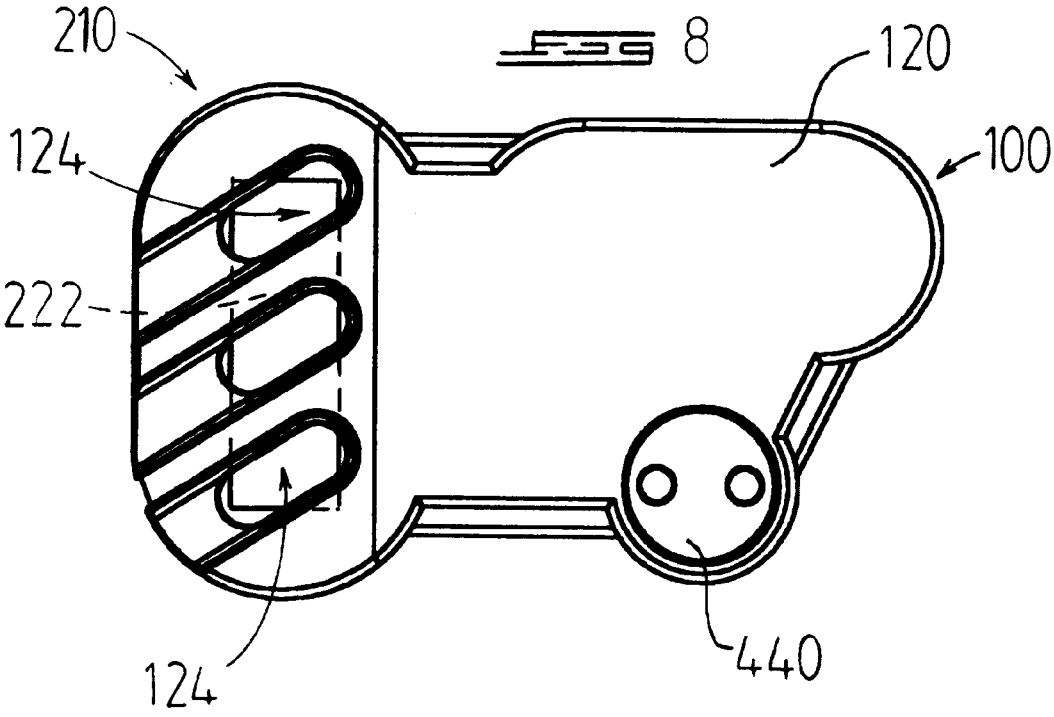
FIG. 8 shows an upper plan view of the plug of FIG. 7.
Figure 9:
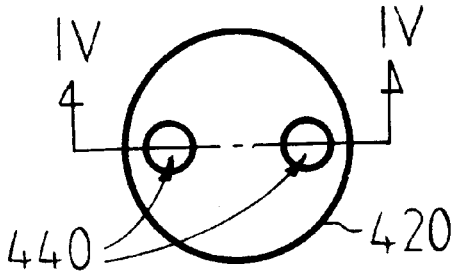
FIG. 9 shows an upper plan view of earthing pin on an enlarged scale, forming part of the plug of FIGS. 7 and 8.
Figure 10:
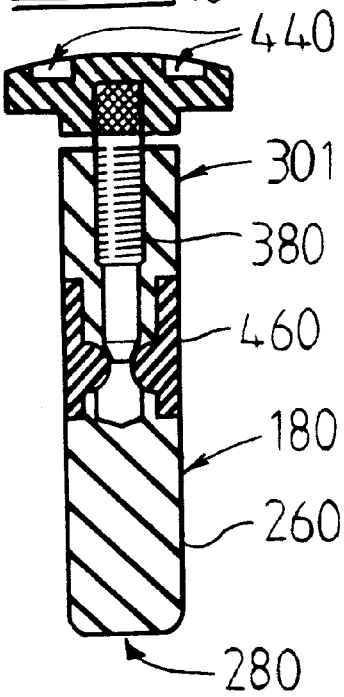
FIG. 10 shows a sectional view taken along IV—IV on the pin of FIG. 9, viewed in side elevation.
Figure 11:
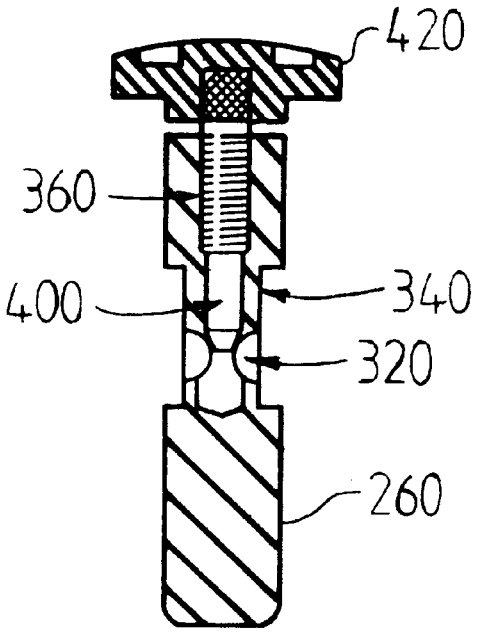
FIG. 11 shows the pin of FIG. 10 having its resilient, frictional band removed.
Figure 12:
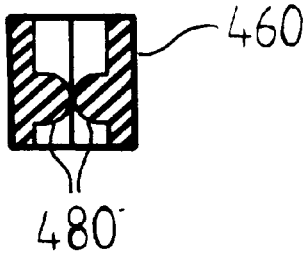
FIG. 12 shows a sectional view of a resilient, frictional band forming part of the pin of FIG. 9.

FIGS. 7 to 12 illustrate a more preferred embodiment of the present invention. In FIGS. 7 and 8, reference numeral 100 generally denotes an electrical plug according to the present invention. The plug 100 has a moulded body 120 of a known insulating, plastics material, supporting a pair of brass pins 140 and 160, and an earthing pin 180, which is illustrated more fully by FIGS. 9 to 12.

The pins 140, 160 and 180 are arranged and dimensioned to fit in known fashion into respective sockets of an existing electrical outlet (not shown). In use the plug 100 links the main power supply to an appliance (not shown) by way of an electrical cord (not shown) which is connected to the pins 140, 160 and 180 inside the body 120 in known fashion.

The body 120 includes a shielding formation 201 which in use denies casual users access to an electrical switch 222 located adjacent to a main outlet into which the plug 100 is inserted. The switch 222 remains partially accessible, however, by way of oblique apertures 124 in the shielding formation 201, thereby making the switch operable by selectively inserting a pin or rod through the appropriate aperture.

The earthing pin 180 described more fully below forms an important feature of the plug 100. The pin 180 has an elongate, cylindrical brass body 260 of circular cross section, extending from a rounded tip 280 to a blunt termination 301, which is located within the plug body 120 during use.

A transverse passage 320 extends through the body 260, intersecting the longitudinal axis of the pin 180, and terminating at either end in a circumferential groove 340 in the body 260. A bore 360 arranged in co-axial relationship to the pin body 260 commences from the blunt termination 301 of the pin body, and intersects the transverse passage 320.

The bore 360 has internal thread formations extending from the pin body termination 301 towards the transverse passage 320. These thread formations co-operate with a threaded shank 380 having a tapered tip 400. A moulded plastic cap 420 (shown separately in FIG. 9) is located at the other end of the shank 380, remote from the tip 400.

In use, the cap 420 nests with slight lateral clearance inside a corresponding recess in the plug body 120. The cap 420 has a pair of recesses 440 generally directed in parallel relationship to the shank 380, and spaced radially from it. The recesses 440 are generally arranged to permit insertion of a customized tool (not shown) for rotating the shank 380 about its longitudinal axis.

The pin 180 further includes a frictional element which includes a split band 460 of a resilient, moulded plastics material which nests within the circumferential groove 340 of the pin body 260. The band 460 has a pair of opposing, radially converging nodes 480 forming opposing, convexly curved surfaces. The dimensions of the nodes 480 are such that they are slidingly insertable into respective ends of the transverse passage 320, with slight lateral clearance.

When the band 460 is fully seated inthe circumferential groove 340 it presents an outwardly facing surface which generally conforms with the adjacent outer peripheral surface of the pin body 260. At the same time the nodes 480 are in close proximity to the tapered tip 400 of the threaded shank 380.

Once the plug 100 is located in an existing mains outlet and the pins 140, 160 and 180 are located in their respective sockets the shank 380 and its cap 420 function as a locking means. More particularly, the tip 400 of the shank 380 is urged towards the nodes 480 by rotating the cap 420 with the appropriate tool.

As the tip 400 bears against the nodes 480 the band 460 expands radially outwardly until it comes to bear against an adjacent portion of its associated socket. The pin 180 is hence frictionally locked inside its socket, thereby counteracting extraction of the electrically conducting pins 140 and 160 from their respective sockets.

The direct connection between the band 460 and the nodes 480 generally ensures that the nodes tend to hold the band captive on the pin body 260, even when the outwardly facing surface of the band projects well beyond the adjacent surface of the pin body 260.

A skilled reader will appreciate that the embodiment described above lends itself to numerous modifications and adaptations, comprising the principal features of the present invention. The scope of the accompanying claims should accordingly not be construed as being confined in any way to the features of the preferred embodiment described above.

What is claimed is:

1. A method of securing the continuity of a power supply to an appliance having an electrical cord connected to a plug having at least a pair of electrically conducting pins and a passive pin which are simultaneously receivable in respective sockets of an existing electrical outlet comprising the steps of:

inserting the conducting pins and the passive pin into their respective sockets to establish a power supply path along the cord to the appliance; and displacing a threaded screw lying in a threaded passage through the passive pin towards a transverse passage through the passive pin such that said threaded screw is interposed between a pair of formations located in a transverse passage through said passive pin, wherein said pair of formations are integrally connected to a resilient frictional element that is circumferentially held captive on the passive pin by a corresponding groove in the passive pin, such that the formations radially expand the resilient frictional element beyond an outer peripheral region of the passive pin and towards an adjacent portion of its associated socket in order to counteract extraction of the pins from their respective sockets.

2. A method according to claim 1 which further comprising the step of restricting access to an electrical switch associated with the electrical outlet into which the plug is inserted by way of a shielding means connected to the plug.

3. A plug for securing the continuity of a power supply through an electrical cord to an electrical appliance comprising:

an insulating body supporting at least a pair of electrically conducting pins for establishing an electrical power supply path along the cord, and a passive pin spaced from the conductive pins, all pins being simultaneously receivable in respective sockets of an existing electrical outlet;

a passage extending transversely through the passive pin such that two extremities at an outermost peripheral region of the passive pin are respectively defined;

a resilient frictional element held captive on the passive pin by a corresponding groove in the passive pin and overlying the extremities of the transverse passage through the passive pin, the frictional element having a pair of formations integrally connected thereto, and slidingly insertable into the respective extremities of said transverse passage; and a locking means on the passive pin, for laterally displacing the formations of the frictional element that in use, operates to urge the frictional element toward an adjacent portion of its associated socket, thereby counteracting extraction of the conducting pins and the passive pin from their respective sockets.

4. A plug according to claim 3 further comprising a shielding formation for shielding at least partially an electrical switch located adjacent to an electrical outlet for use in conjunction with the plug.

5. A plug according to claim 3 or 4 in which the resilient frictional element is in the form of a split band fitting into a corresponding circumferential groove in an outer peripheral region of the passive pin.

6. A plug according to any one of claims 3 to 4 in which the formations on the frictional element include a pair of opposing nodes, integrally connected to the frictional element, which converge radially towards each other.

7. A plug according to any one of claims 3 to 4 in which the locking means comprises a threaded shank having a tip which is locatable between the formations of the frictional element in order to laterally displace the formations during use and thereby urge the frictional element radially outwardly in relation to the passive pin.

8. A plug according to claim 5 in which the formations on the frictional element include a pair of opposing nodes, integrally connected to the frictional element, which converge radially towards each other.

9. A plug according to claim 5 in which the locking means comprises a threaded shank having a tip which is locatable between the formations of the frictional element in order to laterally displace the formations during use and thereby urge the frictional element radially outwardly in relation to the passive pin.

10. A plug according to claim 6 in which the locking means comprises a threaded shank having a tip which is locatable between the formations of the frictional element in order to laterally displace the formations during use and thereby urge the frictional element radially outwardly in relation to the passive pin.

11. A pin for use on a plug for securing a continuous power supply path through an electrical cord to an appliance comprising:

an elongate body which is receivable into a complementary socket of an electrical outlet;

a passage extending transversely through the elongate body such that two extremities at an outermost peripheral region of said body are respectively defined;

a resilient frictional element held captive on said body by a corresponding groove and overlying the extremities of the transverse passage through said body, the frictional element further comprises a pair of formations integrally connected thereto, and slidingly insertable into the respective extremities of said transverse passage; and locking means for laterally displacing the formations on the frictional element that in use, operates to urge the frictional element radially outwardly in relation to the body.

* * * * *